United States Patent [19]

Henzler et al.

[11] 3,937,056

[45] Feb. 10, 1976

[54] WORKPIECE TRANSLATION MECHANISM FOR TRANSFER DIE PRESS

[75] Inventors: William G. Henzler, Sylvania; Robert A. Parker, Toledo, both of Ohio

[73] Assignee: Henzler Mfg. Corporation, Toledo, Ohio

[22] Filed: Mar. 25, 1975

[21] Appl. No.: 561,864

[52] U.S. Cl. ..... 72/405; 72/419

[51] Int. Cl.[2] ..... B21D 43/05

[58] Field of Search ..... 72/405, 419, 421; 214/1 BC, 1 B

[56] References Cited

UNITED STATES PATENTS

| | | | |
|---|---|---|---|
| 3,011,464 | 12/1961 | Danly | 72/405 |
| 3,079,817 | 3/1963 | Sanford | 72/405 |
| 3,105,399 | 10/1963 | Strugala | 72/405 |
| 3,385,094 | 5/1968 | Brutting | 72/419 |
| 3,422,657 | 1/1969 | Grombka | 72/405 |
| 3,434,328 | 3/1969 | Taniguchi | 72/405 |
| 3,541,834 | 11/1970 | Wallis | 72/405 |
| 3,834,213 | 9/1974 | Henzler | 72/405 |

*Primary Examiner*—C. W. Lanham
*Assistant Examiner*—Gene P. Crosby

[57] ABSTRACT

This invention relates to a workpiece translation mechanism for moving successive workpieces through successive stations of a transfer stamping die. Workpiece engaging mechanisms are provided on a top subframe which is mounted on an intermediate subframe for horizontal motion parallel to the path of the workpieces through the transfer die. The intermediate subframe is mounted on a bottom subframe for horizontal reciprocating movement transverse to the path of the workpieces. The bottom subframe is mounted for relative vertical reciprocating motions with respect to the bed of the transfer press. Appropriate mechanical driving arrangements are provided for both the top and intermediate subframes so that both horizontal movements are respectively accomplished with an harmonic acceleration and deceleration of the respective subframes so that they are at essentially zero velocity when they reach each extreme of their reciprocatory positions. In this manner, the possibility of the workpiece being inaccurately aligned with the station of the transfer stamping die is substantially minimized.

2 Claims, 3 Drawing Figures

WORKPIECE TRANSLATION MECHANISM FOR TRANSFER DIE PRESS

BACKGROUND OF THE INVENTION

Transfer stamping dies have long been utilized in the metal stamping industry. There have been a number of mechanisms heretofore proposed for automatically effecting the movement of a workpiece through the successive stations of a transfer die. See for example, the disclosure of U.S. Pat. No. 3,834,213, issued to Henzler et al. It is essential that the workpiece engaging mechanism be moved laterally relative to the flow of the workpieces through the press to engage the workpieces when the movable die of the press is in its raised or inactive position. This engagement motion should not be rough or forcible so as to either damage the workpiece or dislodge it by impact from proper engagement by the workpiece engaging mechanism. Thereafter, it is necessary that the workpiece be lifted from the die stations in which they have last been worked upon by vertical motion. It then becomes essential that the workpieces be horizontally translated to exactly overlie the next workpiece station. Again, the motion by which this step is accomplished should preferably involve a harmonic deceleration of the workpieces so they are at essentially zero velocity when they reach the new transfer position. From this position, the workpieces must be moved vertically downwardly into the next respective stations of the transfer die so that they are ready to receive the forming blow from the next reciprocation of the movable die part of the stamping press, and, of course, the workpiece engaging mechanism has to be moved out of the path of the moving die or plunger of the press.

OBJECTS OF THE INVENTION

In accordance with this invention, the workpiece translating mechanism comprises a first subframe which carries the workpiece engaging mechanism and is mounted for horizontal reciprocal motion in a direction parallel to the flow of the workpieces through the transfer die by a sliding connection to a second subframe. The second subframe is mounted for horizontal reciprocating motion perpendicular to the flow of the workpieces through the transfer die on a third subframe. The driving mechanism for accomplishing the horizontal reciprocating motions of both the first and second subframes are constructed to impart harmonic accelerations and decelerations of such workpieces so that when they reach the extreme limits of their reciprocatory motions, they are at substantially zero velocity and also accurately positioned at the proper point relative to the forming stations of the transfer die.

Accordingly, it is an object of this invention to provide an improved workpiece translating mechanism for a transfer die.

A particular object of this invention is to provide a workpiece translation mechanism for a transfer stamping operation, wherein all of the horizontal motions of the workpiece required in shifting same from one work station in the transfer die to the next, are carried out by harmonic motions having substantially zero velocity at each extreme end of the reciprocatory movements.

Other objects and advantages of this invention will become apparent from the following description, taken in conjunction with the annexed sheets of drawings, on which:

DESCRIPTION OF THE INVENTION

Figure 1:
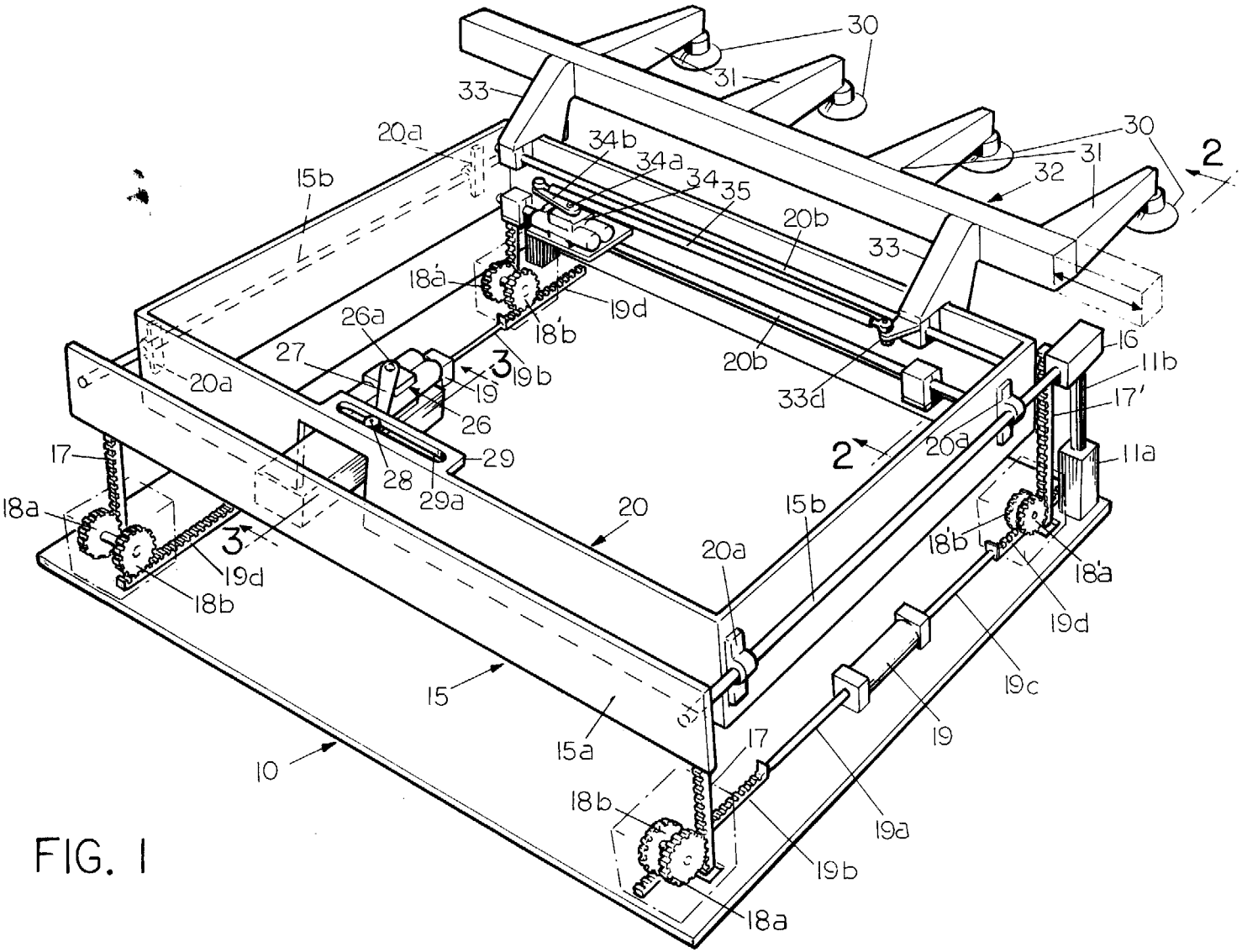
FIG. 1 is a schematic perspective view of a workpiece translation mechanism embodying this invention.
Figure 3:
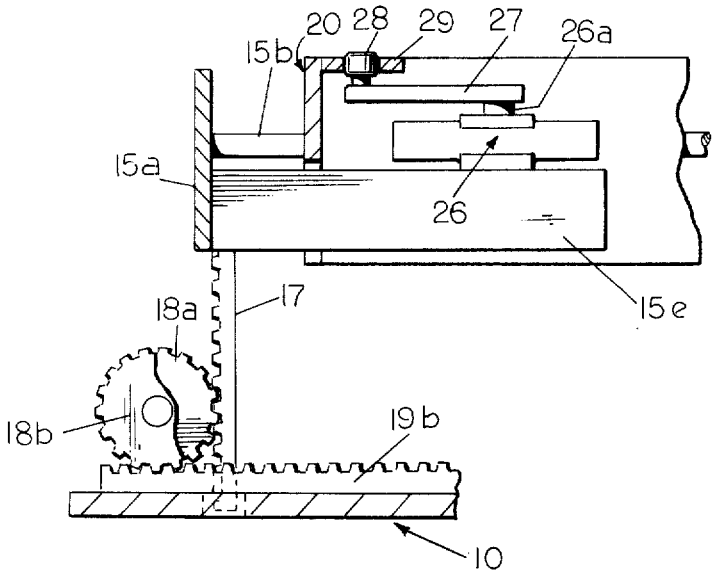
FIG. 3 is a partial sectional view taken on the plane 3—3 of FIG. 1.
Figure 2:
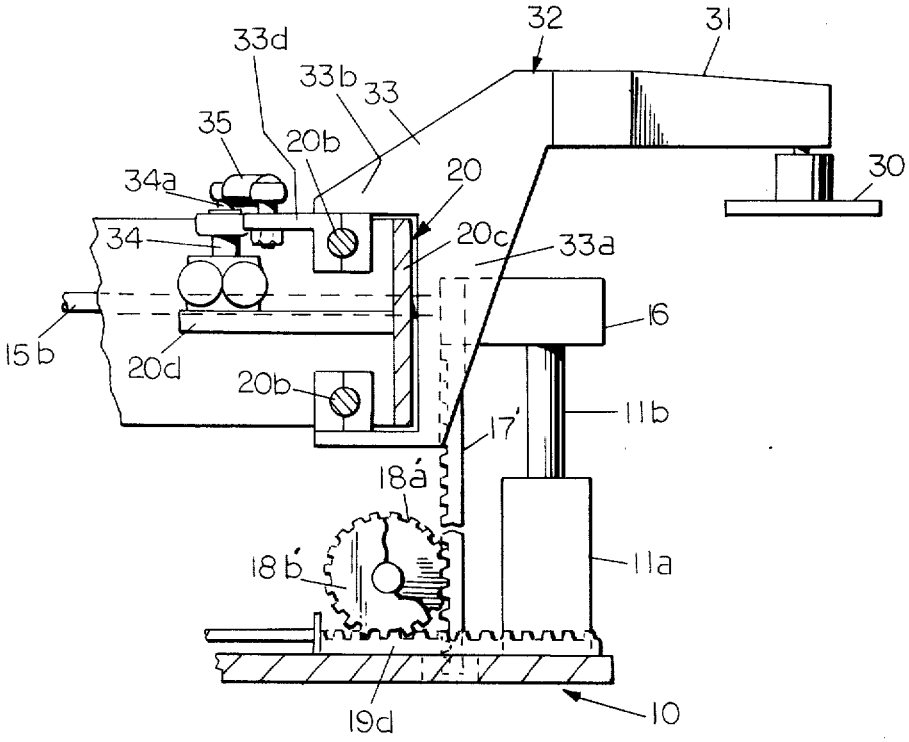
FIG. 2 is a partial sectional view taken on the plane 2—2 of FIG. 1.

Referring to FIG. 1, a base plate 10 is provided which can be either mounted on the platen of a multistation forming press or mounted on a suitable base adjacent such forming press (not shown). The forming press is assumed to have three successive work stations so that a plurality of four aligned workpiece engaging mechanisms 30 are provided to move the workpieces (not shown) successively into and out of each work station. Each mechanism 30 may be magnetically or vacuum operated and is suitably mounted on a projecting arm 31 of a movable support frame 32.

Those skilled in the art will recognize that it is necessary to impart a repeated rectilinear motion in a vertical plane to the workpiece support frame 32 in order to sequentially and successively advance workpieces carried by the workpiece engaging mechanism 30 through the successive stations of the multistation forming die (not shown). Additionally, the frame 32 must reciprocate on a path transverse to the workpiece flow so as to remove the workpiece engaging mechanisms from interference with the moving die part or plunger of the forming press. A series of relatively movable subframes are provided to permit such rectilinear and transverse motions to be imparted to the workpiece support frame 32. The first of such subframes 15 is of U-shaped articulated construction, comprising an end plate **15*a* and two spaced parallel side rods 15*b* respectively secured to the ends of the end plate 15*a*. A pair of blocks 16 are respectively mounted on the other ends of side rods 15*b*. Blocks 16 in turn are mounted on the top of posts 11*b* which are slidably mounted in upstanding guide blocks 11*a* provided on the two corners of the base plate 10.**

At each end of the endplate **15*a*, a depending rack 17 is integrally mounted which is engaged by a gear 18*a*, which is in turn driven by a gear 18*b* engaged by a rack 19*b* controlled by rod 19*a* of a double rod hydraulic cylinder 19. The opposite rod 19*c* of the hydraulic cylinder 19 moves a rack 19*d* which drives a similar pair of gears 18'*b* and 18'*a*. Gear 18'*a* operates on a depending rack 17' secured to the blocks 16 at the corner of the subframe 15. The same mechanism is provided for the other side of frame 15, thus first subframe 15** is mounted for vertical reciprocating movements relative to the multistation die (not shown).

The parallel side rods **15*b* of the first subframe 15 provides means for slidably mounting a rectangular intermediate subframe 20. Subframe 20 has slide bearing brackets 20*a* secured to its side walls and respectively slidably engaging the rods 15*b* so as to permit the intermediate subframe 20 to move in a direction perpendicular to the flow of the workpieces through the transfer die. The mechanism for imparting the transverse horizontal reciprocating motion to the intermediate subframe 20** will be described shortly.

The workpiece support frame 32 is slidably mounted on a pair of vertically spaced, longitudinally extending rods **20*b* provided on the interior of the rectangular intermediate subframe 20. Mounting brackets 33** are integrally secured to the workpiece support subframe 32 and each has a J-shaped depending portion 33*a*, which extends downwardly and around the front wall 20*c* of the intermediate subframe 20 and slidably engages the bottom rod 20*b*, and another portion 33*b* which projects over and behind front wall 20*c* and is slidably journalled on the top slide rod 20*b*. Thus the workpiece support frame 32 is mounted for horizontal reciprocal movements parallel to the flow of workpieces through the transfer die.

In accordance with this invention, the driving mechanisms for both the intermediate subframe 20 and the workpiece support frame 32 are designed to provide harmonic acceleration of such frames with the primary characteristic that the horizontal velocity of the workpiece support frame is substantially zero when it approaches any extreme of its horizontal positions.

Accordingly, the drive mechanism for the workpiece support frame 32 comprises an angular type hydraulic cylinder 34 mounted on a plate 20*d* secured to the intermediate frame 20. Cylinder 34 is of the type producing a 180° rotational movement of an output shaft 34a. A crank arm 34*b* is keyed to output shaft 34*a* and connected by a link 34 to an appropriate bracket 33*d* provided on the workpiece support frame mounting bracket 33*d*. Thus, as the crank arm 34*b* is reciprocated through a 180° stroke, the resulting motion imparted to the workpiece support frame 32 is a horizontal reciprocal linear motion, but the workpiece support frame 32 is at essentially zero velocity as it approaches each of its extreme positions.

In similar fashion, an angular hydraulic actuator 26 is provided for the intermediate support frame 20. Actuator 26 is mounted on a support plate 15e which is secured to the primary subframe 15. It comprises a hydraulic cylinder having an output shaft 26*a* and an arm 27 secured thereto and reciprocating through a 180° angular movement. The other end of arm 27 mounts a roller 28 which slidably engages a slot 29*a* formed in a plate 29 attached to the end wall of the intermediate frame 20. Thus, as the cylinder 26 is actuated, the intermediate frame 20 is reciprocated in a direction perpendicular to the flow of workpieces through the transfer die, but more importantly, the velocity of the intermediate frame 20 as it approaches either of its two extreme horizontal positions is essentially zero due to the harmonic motion imparted by the angular hydraulic actuator 26.

Appropriate conventional hydraulic controls (not shown) are provided for each of cylinders 19, 26, and 34 to operate such in proper sequence to accomplish the desired translation movement of the workpieces.

While the specific embodiment of the invention illustrated in the drawings and herein described calls for the workpiece support frame to be moved parallel to the flow of the workpieces through the transfer die and the intermediate support frame to be moved perpendicular to such flow, it will be apparent to those skilled in the art that these two motions could be readily reversed, i.e., the workpiece support frame 32 could be mounted on the intermediate frame 20 to provide a harmonic reciprocating motion in a direction transverse to the flow of the workpieces and the intermediate subframe 20 be mounted relative to the primary subframe so as to move in a direction parallel to the flow of the workpieces through the transfer die, and the appended claims are intended to cover either of these alternative arrangements.

The important fact is that all horizontal motions of the workpiece engaging mechanisms 30 approach substantially zero velocity each time that the workpiece engaging mechanism approaches the next work station, or when the workpiece engaging mechanism approaches the workpiece (not shown) to engage same. It is thus insured that the workpiece will not be damaged or jarred out of proper position by an impact engagement of the workpiece holding mechanism therewith or moved to an improper position with respect to the forming stations in the forming die due to sudden deceleration of the motion of the workpiece support as it approaches such station. Thus the accuracy of the workpiece translation movement through the forming die has been substantially improved.

We claim:

1. A workpiece transfer mechanism for a multistation die of a transfer press comprising, in combination:
   1. A main frame structure disposed adjacent said transfer press and fixedly secured relative thereto;
   2. A first subframe disposed in overlying relationship to said main frane, first power means for vertically reciprocating said first frame relative to said main frame, the extent of said vertical movement corresponding to the vertical movement required to lift a workpiece out of a die station;
   3. A second subframe slidably mounted on said first subframe for horizontal reciprocating movement in a direction transferse to the progressive movement of the workpieces through the successive stations of said die, second power means for reciprocating said second subframe, said second power means including linkage means for accelerating and decelerating said second subframe so that said second subframe approaches each end of its stroke with essentially zero velocity; and
   4. A third subframe slidably mounted on said second subframe for horizontal reciprocating movement in a direction parallel to the progressive movement of the workpieces through the successive stations of said die, a plurality of workpiece holders mounted on said third subframe and projecting toward said die, the stroke of said movement of said third subframe being equal to the spacing of the stations of said die, third power means for reciprocating said third subframe through said stroke, said third power means including linkage means for accelerating and decelerating said third subframe so that said third subframe approaches each end of its stroke with essentially zero velocity.

2. The combination defined in claim 1, wherein said linkage means comprises a power actuated pivoted arm reciprocal through a 180° horizontal arc and means pivotally interconnecting the free end of said arm to the respective subframe.

* * * * *